US006446695B1

(12) United States Patent
Forsland

(10) Patent No.: US 6,446,695 B1
(45) **Date of Patent: *Sep. 10, 2002**

(54) SINGLE ROLL-UP DOOR WITH PLURAL DOOR FACADE

(76) Inventor: Kent H. Forsland, 283 Troy St., River Falls, WI (US) 54022

( * ) Notice: Subject to any disclaimer, the term of this patent is extended or adjusted under 35 U.S.C. 154(b) by 0 days.

This patent is subject to a terminal disclaimer.

(21) Appl. No.: 08/814,272

(22) Filed: Mar. 10, 1997

Related U.S. Application Data

(63) Continuation-in-part of application No. 09/055,656, filed on Jun. 10, 1996, which is a continuation-in-part of application No. 08/601,777, filed on Feb. 15, 1996, now abandoned, which is a continuation-in-part of application No. 29/040,278, filed on Jun. 14, 1995, now Pat. No. Des. 378,421.

(51) Int. Cl.[7] ..... E05D 15/16

(52) U.S. Cl. ..... 160/201; 160/236; D25/48; 52/311.2; 52/314

(58) Field of Search ..... 160/201, 236, 160/133; 52/311.1, 314; D25/48

(56) References Cited

U.S. PATENT DOCUMENTS

| | | | | |
|---|---|---|---|---|
| 1,881,778 A | | 10/1932 | Madsen | |
| 1,922,370 A | | 8/1933 | Johnson et al. | |
| 2,093,020 A | | 9/1937 | Norberg | |
| 2,242,499 A | | 5/1941 | Ainsworth | |
| D245,263 S | | 8/1977 | Andresen | |
| D245,264 S | * | 8/1977 | Andresen | |
| D245,265 S | * | 8/1977 | Andresen | |
| 4,060,437 A | | 11/1977 | Strout | |
| 4,339,487 A | | 7/1982 | Mullet | |
| 4,854,365 A | | 8/1989 | Juneau | |
| 5,016,700 A | | 5/1991 | Wegner et al. | |
| 5,060,711 A | | 10/1991 | Fimbell | |
| 5,123,211 A | | 6/1992 | Schlicht et al. | |
| 5,168,915 A | | 12/1992 | LaFleur | |
| 5,341,597 A | * | 8/1994 | Stoltenberg | |
| 5,626,176 A | * | 5/1997 | Lewis, Jr. et al. | 160/201 |
| 6,227,278 B1 | * | 5/2001 | Forsland | |

* cited by examiner

*Primary Examiner*—Blair M. Johnson
(74) *Attorney, Agent, or Firm*—Merchant & Gould P.C.

(57) ABSTRACT

A roll-up door has a plurality of horizontally extended panels hinged together to permit the door to be moved between a vertical-orientation and a horizontal orientation relative to a doorway. A frame has border side members, a center member, and a top member secured to the outside to the panels exposes portions of the front walls of the panels. The exposed portions of the panels have door facades whereby the garage door has the appearance of two or more doors.

4 Claims, 9 Drawing Sheets

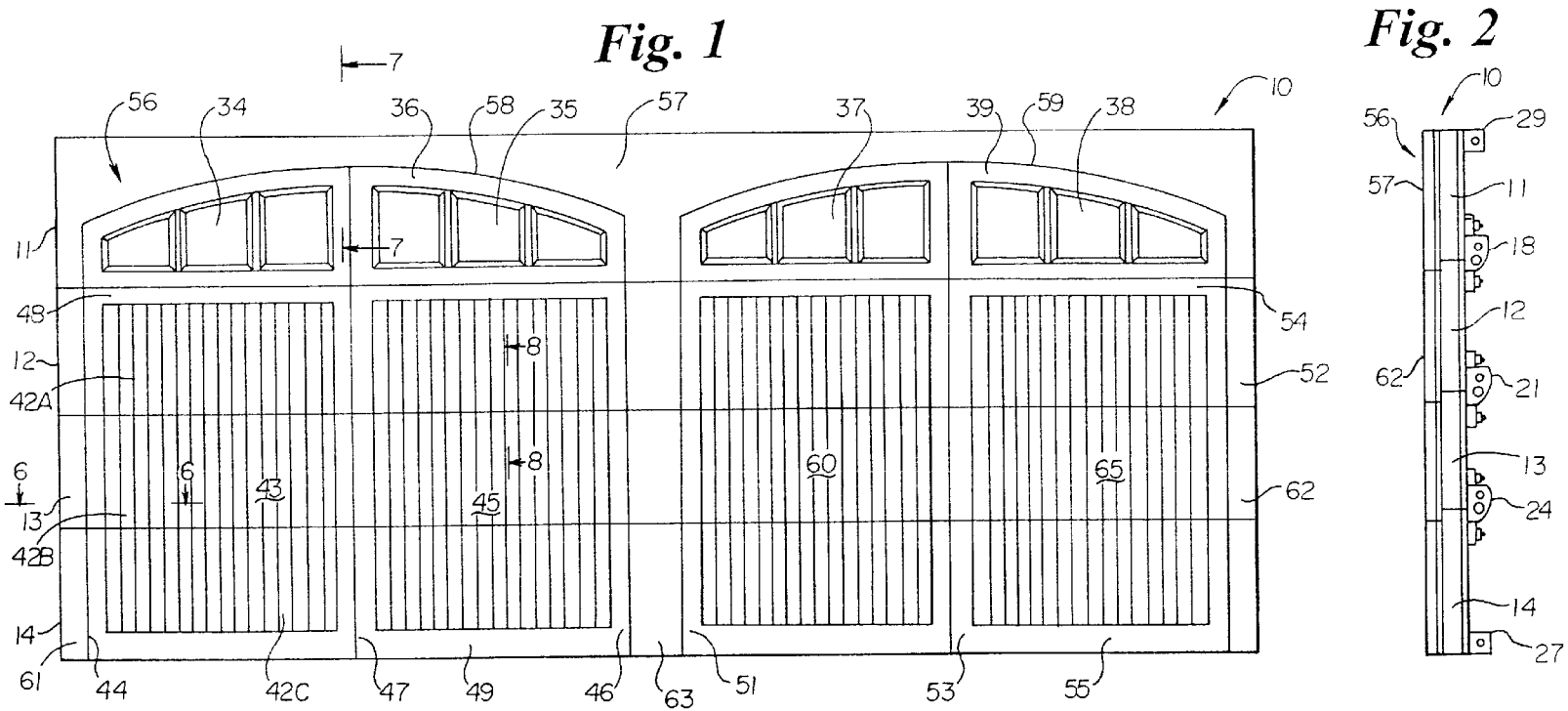
Fig. 1
Fig. 2
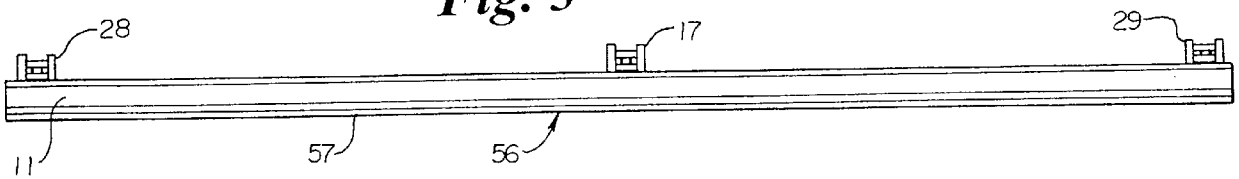
Fig. 3

SINGLE ROLL-UP DOOR WITH PLURAL DOOR FACADE

CROSS REFERENCE TO RELATED APPLICATIONS

This application is a continuation-in-part of U.S. application Ser. No. 08/601,777 filed Feb. 15, 1996, and U.S. application Ser. No. 29/040,278 filed Jun. 14, 1995, now U.S. Pat. No. Des. 378,421, and U.S. application Ser. No. 29/055,656 filed Jun. 10, 1996, now U.S. Pat. No. Des. 397,447.

FIELD OF THE INVENTION

The invention relates to doors used to selectively open and close openings in structures. The doors include roll-up garage doors used with buildings having doorways located in a vertical position to-close the doorway and a horizontal position to open the doorway.

BACKGROUND OF THE INVENTION

Garage doorways in antiquated garages are closed with swinging doors attached to upright supports with hinges. These doors must be moved outwardly to open the doorway. The swinging doors require ground and head clearances to allow the doors to open and close. The designs of the swinging doors are having an architectural renaissance. In order to obviate the clearance requirements of the swinging doors, laterally roll open doors were developed. The roll open doors have a number of vertical sections hinged together in side-by-side relation. The doors are supported on right angle tracks for movement along the tracks between a closed position and an open position. The tracks are mounted on headers above the doorways and side supports extended inwardly from one side of vehicles in the garages. This makes is difficult to access and egress from the side of the vehicles adjacent the open doors. This problem was overcome with roll-up overhead doors. The roll-up overhead doors have horizontal panels that are hinged together. Roller mount the panels on side tracks having vertical and horizontal sections to locate the door in a vertical closed position and an overhead horizontal position.

SUMMARY OF THE INVENTION

The invention relates to a roll-up overhead door having a plurality of transverse panels for closing a doorway in a structure, such as a garage. Adjacent panels are connected with hinges to allow the door to articulate from a vertical position to a horizontal position as it moves along the side tracks which support the door adjacent a doorway. A border frame mounted on the front of the panels has openings accommodating a door facade. The frame has upright side members and a transverse top member joined to the side members providing an outline of a doorway for the door facade.

An embodiment of the roll-up overhead door has a plurality f transverse panels comprising a top panel, a bottom panel, and intermediate panels. Hinges connect adjacent panels to allow the door to articulate from a vertical position to a horizontal position as it moves along side tracks which support the door adjacent a doorway. Each panel has framework to cover the inside of the framework. An outside wall of each panel includes sheet members attached to the framework to cover the outside of the framework. The outside sheet members are two or more one-piece wood sheet materials, such as exterior cedar plywood. The lower edges of the outside sheet members overlap an upper portion of the framework of an adjacent panel to provide a stepped interface between adjacent panel which inhibits the flow of wind, dust, water, and snow through the door. A border frame attached to the outside of the panels sets out a pair of openings that simulate side-by-side doorways. The border frame has upright side border frame members on opposite sides of the panels, an upright center border frame member attached to the panels midway between the side members, and a horizontal top border frame member attached to the top panel and joined to the side and center border frame members. A swinging double door facade is imparted on the panel sections between the side and center border frame members. In one modification of the door the center border frame has lower upwardly curved or arched bottom edges aligned with panel sections located between the side and center border frame. The swinging door facade has arched windows located below arch bottom edges of the top border frame. The sheet members of the outside walls of the panels are located below the windows.

DESCRIPTION OF THE DRAWINGS

FIG. 1 is a front elevational view of the single roll-up door with the two door facade of the invention;

FIG. 2 is a side elevational of the door of FIG. 1;

FIG. 3 is a top plan view of the door of FIG. 1;

DESCRIPTION OF PREFERRED EMBODIMENT

Figure 4:
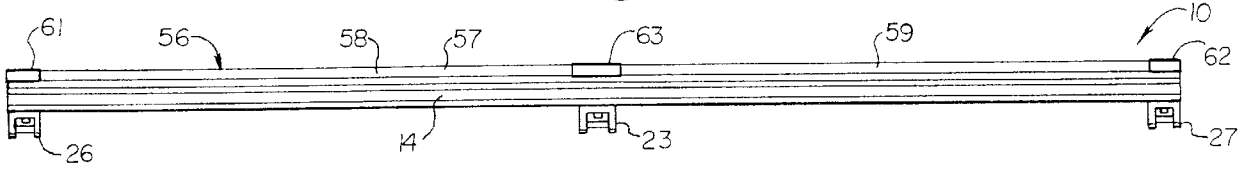
FIG. 4 is a bottom plan view of the door of FIG. 1.

Referring to FIG. 1, there is shown a rectangular single roll-up door or closure 10 for a structure, such as a garage, shop, or building, having a doorway to provide access to the structure. Door 10 is a single two-stall garage door adopted to be movably mounted on conventional side and overhead rails (not shown) for movement between a vertical closed position and an overhead horizontal open position. Door 10 can be used with other structures that have doorways.

Door 10 has a plurality of elongated rectangular panels 11, 12, 13 and 14. Adjacent panels 11, 12 and 12, 13 and 13, 14 are pivotally connected with hinges 16, 17, 18 and 19, 20, 21 and 22, 23, 24, shown in FIG. 5, for pivoted movement about separate parallel horizontal axes. Fasteners, such as bolts or screws, (not shown) attach hinges 16 to 24 to the insides of panels 11 to 14. The hinges 16 to 24 allow the panels 11 to 14 to articulate as door 10 is moved between its open and closed positions. The inside of lower panel 14 has opposite lower corners that support U-shaped brackets 26 and 27. The inside upper or top panel 11 has opposite upper corners that support U-shaped brackets 28 and 29. Brackets 26 to 29 accommodate conventional axle and roller assemblies (not shown) which ride on the side and overhead rails. Hinges 16, 18, 19, 21, 22, 24, have structures that accommodate the conventional axle and rollers assemblies that ride on the side and overhead rails and position door 10 against the door frame when it is in the closed position.

Top panel 11 has a first set of facade windows 34 and 35 and a second set of facade windows 37 and 38. Each set of windows have horizontal bottom edges and arched or arcuate upper edges that follow arched top members 36 and 39. Windows 34 comprise three separate windows which increases in height from the middle of panel 11 to toward windows 34. Each panel 12, 13, and 14 has outside walls 42A, 42B, and 42C below windows 34 and 35. Upright side members 44 and 46 and upright member 47 divide about one half of outside walls 42A, 42B, and 42C in two sessions 43 and 45 located below windows 34 and 35. Member 47 has a vertical groove 47A that extends through top member 36 to provide a double swing door facade. Upper and lower horizontal border members 48 and 49 are joined to upper and lower ends of the upright side border members 44 and 46 and center member 47. Sections 43 and 45 along with windows 34 and 35 outlined with border members 36, 44, 46, 47, 48, and 49 form a double swing door facade.

Windows 37 and 38 are identical to windows 34 and 35 providing door with lateral symmetry and a two double swing door facade. Windows 37 comprise three windows having linear horizontal bottom edges and outwardly arched upper edges that follow arch member 39. Windows 38 comprise three windows having linear horizontal edges and inwardly arched upper edges that follow arch member 39. Arch members 36 and 39 have the same convex curvature. The common shape of the arches can be a sector of a circle, lancet, ogee, basket-handle, or tudor configurations. The top border frame member can have linear horizontal lower edges to provide the facade doors with rectangular configurations. The top border frame member can have a single bottom edge to provide a door section for a single door facade.

The right portions of outside walls 42A, 42B and 42C are enclosed within upright side border frame members 51 and 52 and top and bottom border frame members 54 and 55. A center border frame member 53 divides the outside wall 42 between border frame members 51 and 52 into two substantially equal sections 60 and 65. Member 53 has a vertical groove 53A extended through top member 39. Sections 60 and 65 along with windows 37 and 38 outlined with border frame members 51, 52, 53, 54, and 55 form a double swing open second door facade.

Outside walls 42A, 42B, and 42C of each panel 12, 13, and 14 comprise one or more wide sheets of material, such as cedar plywood. Each sheet member can have a width of four feet. The outer faces of the outside walls 42A, 42B, and 42C have vertical grooves or arabesques. The sheet material reduces air leakage through the door and increases the strength of the door.

Figure 5:
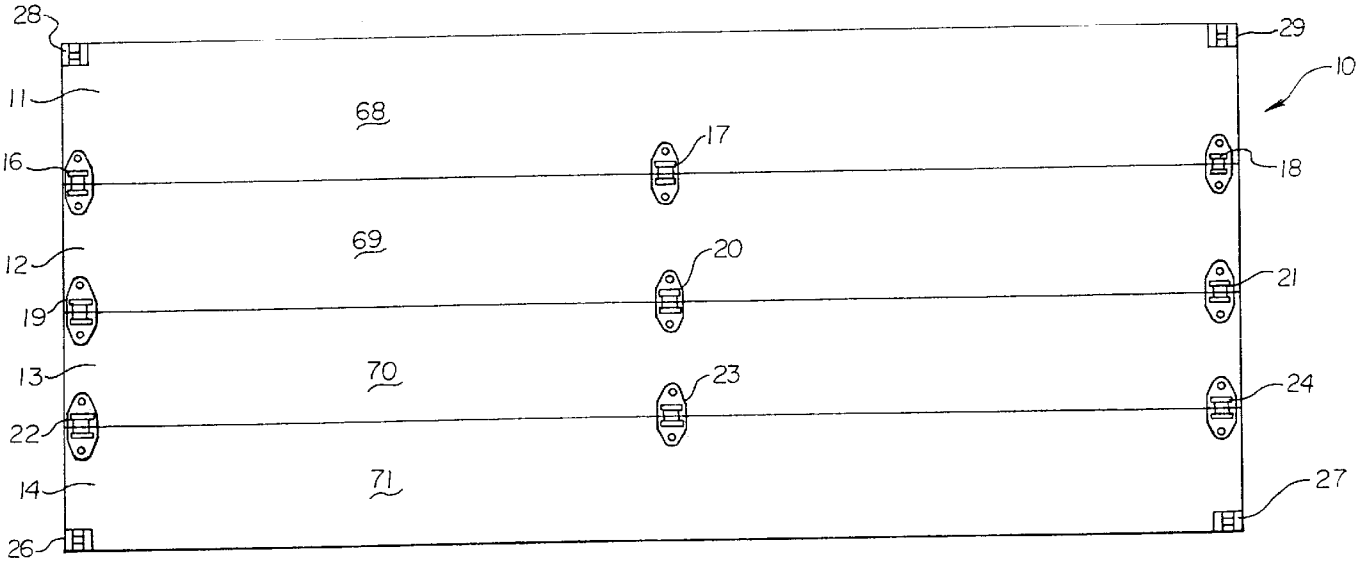
FIG. 5 is a rear elevational view of the door of FIG. 1.

As shown in FIG. 5, door 10 has rectangular inside walls 68, 69, 70, and 71 covering the insides of panels 11 to 14. Top wall 68 can be provided with openings for windows 34, 35, 37, and 38. Each panel has a wood framework comprising side frame members 64 and top and bottom horizonal frame members 66 and 66A such as 2×6 or 1.5×5 inch wood members. Nailers 67 are located inwardly from side members 64. Front wall 42B and rear wall 70 are attached with fasteners, such as bolts or screws, to opposite sides of frame members 64 and 66 and 66A. The space between from wall 42B and rear wall 70 is filled with a foam plastic core 72. Other types of core material can be interposed between walls 42B and 70. Panels 12 and 14 have frame members, inside and outside walls, and foam plastic cores as described for panel 13.

Figure 8:
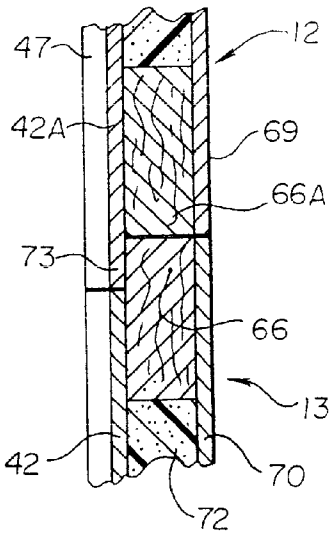
FIG. 8 is an enlarged sectional view taken along line 8—8 of FIG. 1.
Figure 7:
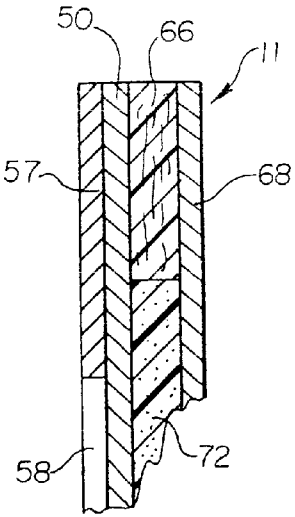
FIG. 7 is an enlarged sectional view taken along line 7—7 of FIG. 1.
Figure 6:
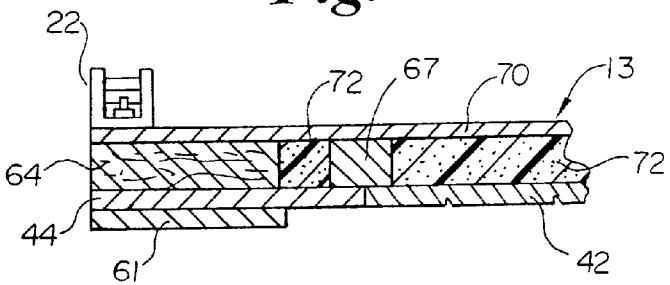
FIG. 6 is an enlarged sectional view taken along line 6—6 of FIG. 1.

As shown in FIG. 8, the front walls 42A of panel 12 has a lower transverse portion 73 that overlaps frame member 66 of panel 13. The inside surface of portion 73 is adjacent an upper portion of frame member 66. The adjacent edges of frame members 66 and 66A are located in a horizontal plane above the meeting edges of front walls 42A and 42B. The lower portion 73 of front 42A minimizes the flow of wind, dust, rain, or snow through spaces between panels 12 and 13. Front wall 42B also has a lower transverse portion that overlaps the upper frame member of panel 14.

The front of door 10 includes a two door frame 56 providing a side and top border for he swing open door facades. Frame 56 has a horizontal top frame member 57 having arched or upwardly concave bottom edges 58 and 59 located over windows 34, 35 and 37, 38. Side border frame members 61 and 62 located along opposite sides of door 10 are attached to members 44 and panel frame members 64. Members 61 and 62 are cut along the horizontal lines of adjacent panels as seen in FIG. 1 to allow the door to articulate as it rolls between its open and closed locations. An upright center or post member 63 is mounted on members 46 and 51. The upper ends of side border frame members 61 and 61 and center frame member 63 are joined to top member 57 at opposite ends of bottom edges 58 and 59. Members 57, 61, 62, and 63 are flat wood boards which extend outwardly from the facade door border members 44, 46, 51, and 52 to recess the facade doors.

Referring to FIGS. 9 to 13, there is shown a first modification of the single roll-up door or closure 100 having a two door facade for a doorway of a structure, such as a garage, shop, or building. The door 100 is movable from a generally vertical closed position to a horizontal open position to provide access to the structure. Door 100 is movable mounted with rollers on conventional side and overhead rails (not shown) for movement manually or with a powered opener between it's open and closed positions. Door 100 is shown as a two-stall garage door for a garage doorway having a width to accommodate two motor vehicles, such as passenger cars, pick-up trucks and vans.

Door 100 has a plurality of elongated rectangular panels 111, 112, 113 and 114. Adjacent panels 111, 112 and 112, 113 and 113, 114 are pivotally connected with hinges 116, 117, 118 and 119, 120, 121 and 122, 123, 124 shown in FIG. 11, to permit articulated movement of the panels relative to each other as door 100 moves between it's open and closed positions and retain adjacent panels in side-by-side locations. Fasteners, each as bolts or screws (not shown) attach hinges 116 to 124 to the insides of panels 111 to 114. The inside of lower panel 114 has opposite lower corners supporting U-shaped brackets 126 and 127. The inside of upper or top panel 111 has opposite upper corners that support U-shaped brackets 128 and 129. Brackets 126 to 129 accommodate conventional axle and roller assemblies (not shown) which ride on side and overhead rails. Hinges 116, 118, 119, 121, 122, 124 have structures that accommodate the conventional axle and roller assemblies that ride on the side and overhead rails and position door 100 against the door frame when it is in the closed position.

Figure 9:
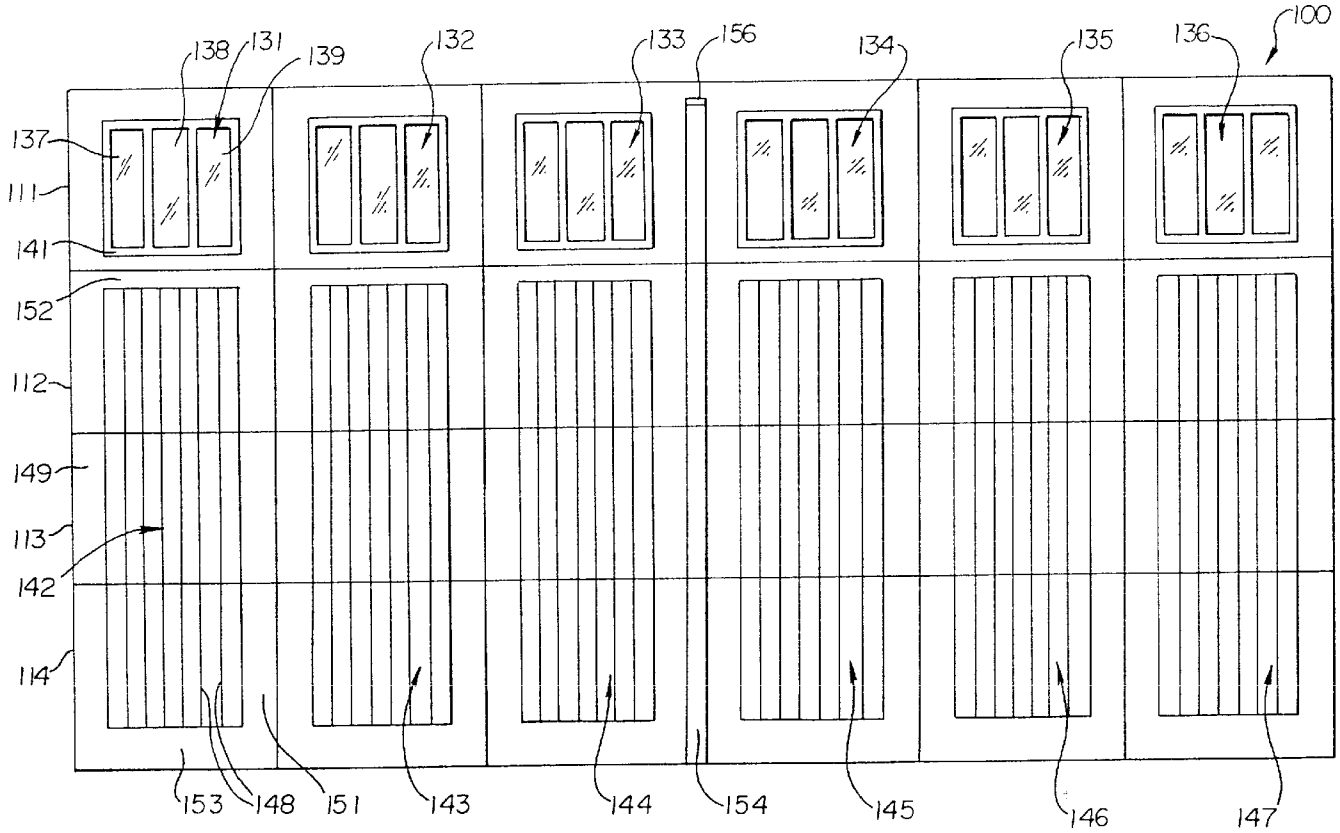
FIG. 9 is a front view of a first modification of a single roll-up door with two door facades of the invention.
Figure 11:
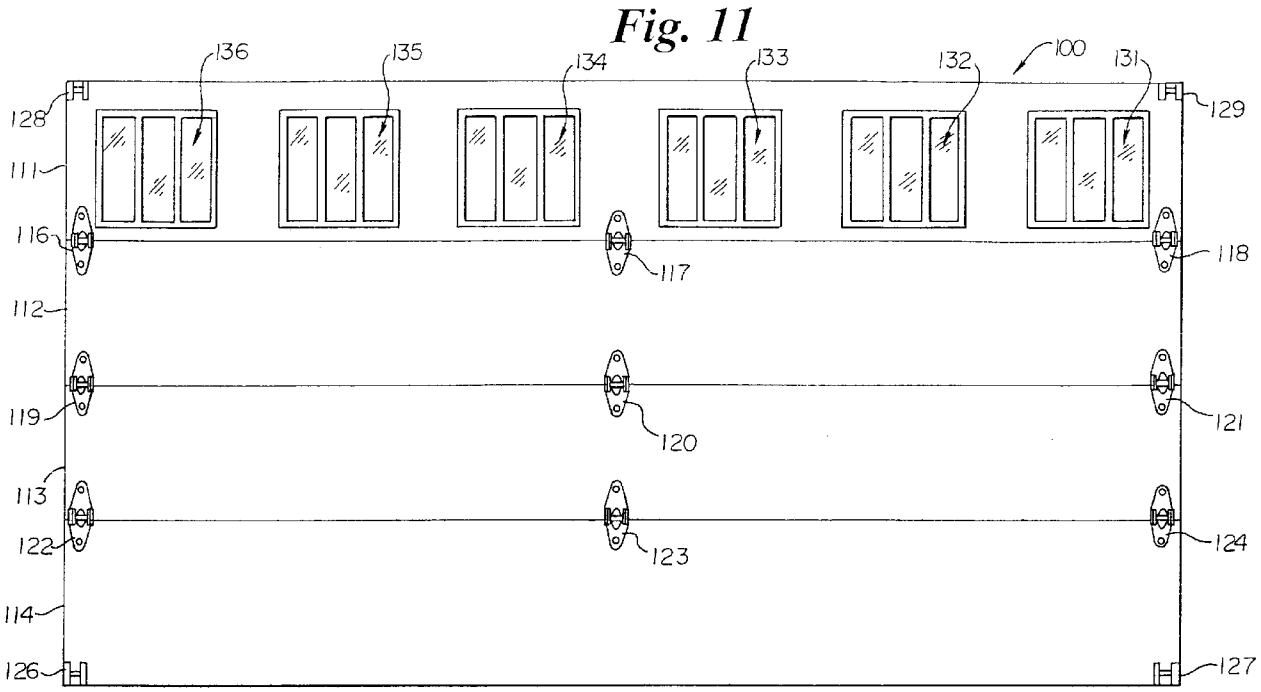
FIG. 11 is a rear plan view of the door of FIG. 9.
Figure 12:
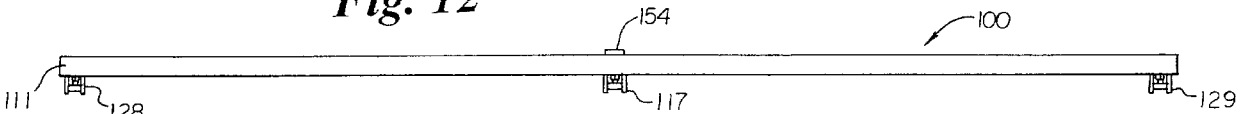
FIG. 12 is a top plan view of the door of FIG. 9.
Figure 13:
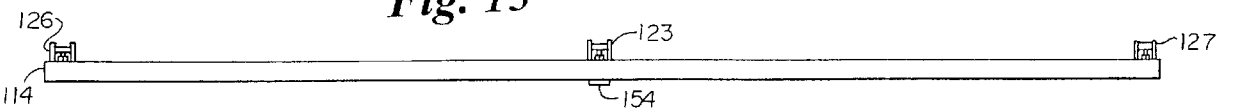
FIG. 13 is a bottom plan view of the door of FIG. 9.

Top panel 111 has six identical windows 131, 132, 133 134, 135 and 136. Each window has three vertical transparent panes 137, 138 and 139 surrounded with a frame 141. As shown in FIG. 9, vertical rectangular recessed sections 142, 143, 144, 145, 146 and 147 are located below windows 131–136. Each section has vertical grooves 148 in a panel or side-by-side boards. Each section is also framed by side members 149 and 151, a top member 152 and a bottom member 153.

Figure 10:
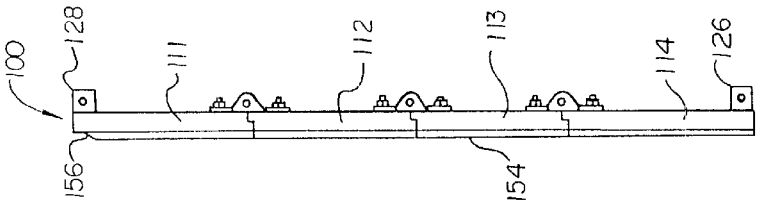
FIG. 10 is a side elevational view of the door of FIG. 9.

An upright center or post member 154 is located between sections 144 and 145 along the vertical middle of door 100. Member 154 has uniform width and extends from the bottom of the door to an upwardly tapered upper end 156. End 156 is located below the top edge of door 100 to allow door 100 to be located in surface engagement with the doorway header when door 100 is closed and permit door 100 to be opened. As seen in FIG. 10, center member 154 extends outwardly from the front of door 100 providing door 100 with a two door facade.

Referring to FIGS. 14 to 18, there is shown a second modification of the single roll-up door or closure 200 having a two door facade for a doorway of a structure, such as a garage, shop, or building. The door 200 is movable from a generally vertical closed position to a horizontal open position to provide access to the structure. Door 200 is movable mounted with rollers on conventional side and overhead rails (not shown) for movement manually or with a powered opener between it's open and closed positions. Door 200 is shown as a garage door for a garage doorway having a width to accommodate a motor vehicle, such as a passenger car, pick-up truck or van.

Door 200 has a plurality of elongated rectangular panels 211, 212, 213 and 214. Adjacent panels 211, 212 and 212, 213 and 213, 214 are pivotally connected with hinges 216, 217, 218 and 219, 220, 221 and 222, 223, 224 shown in FIG. 16, to permit articulated movement of the panels relative to each other as door 200 moves between it's open and closed positions and retain adjacent panels in side-by-side locations. Fasteners, each as bolts or screws (not shown) attach hinges 216 to 224 to the insides of panels 211 to 214. The inside of lower panel 214 has opposite lower corners supporting U-shaped brackets 226 and 227. The inside of upper or top panel 211 has opposite upper corners that support U-shaped brackets 228 and 229. Brackets 226 to 229 accommodate conventional axle and roller assemblies (not shown) which ride on side and overhead rails. Hinges 216, 218, 219, 221, 222, 224 have structures that accommodate the conventional axle and roller assemblies that ride on the side and overhead rails and position door 200 against the door frame when it is in the closed position.

Figure 14:
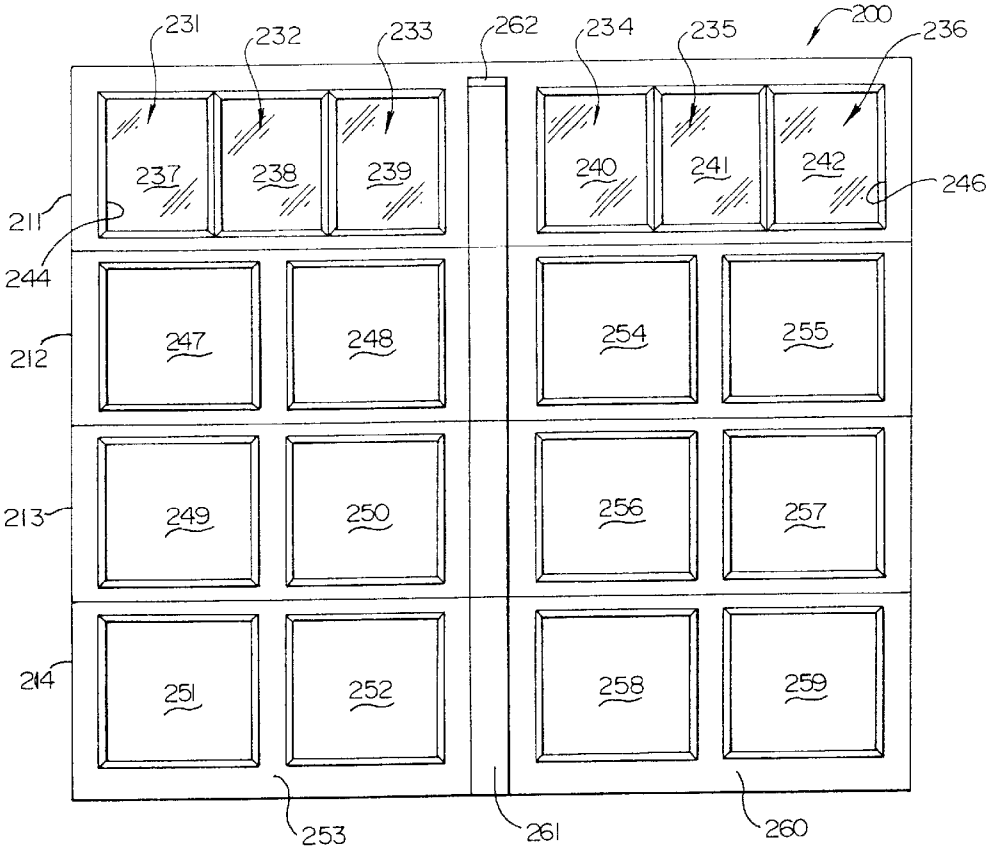
FIG. 14 is a front elevational view of a second modification of a single roll-up door with two facades of the invention.
Figures 16, 17, 18:
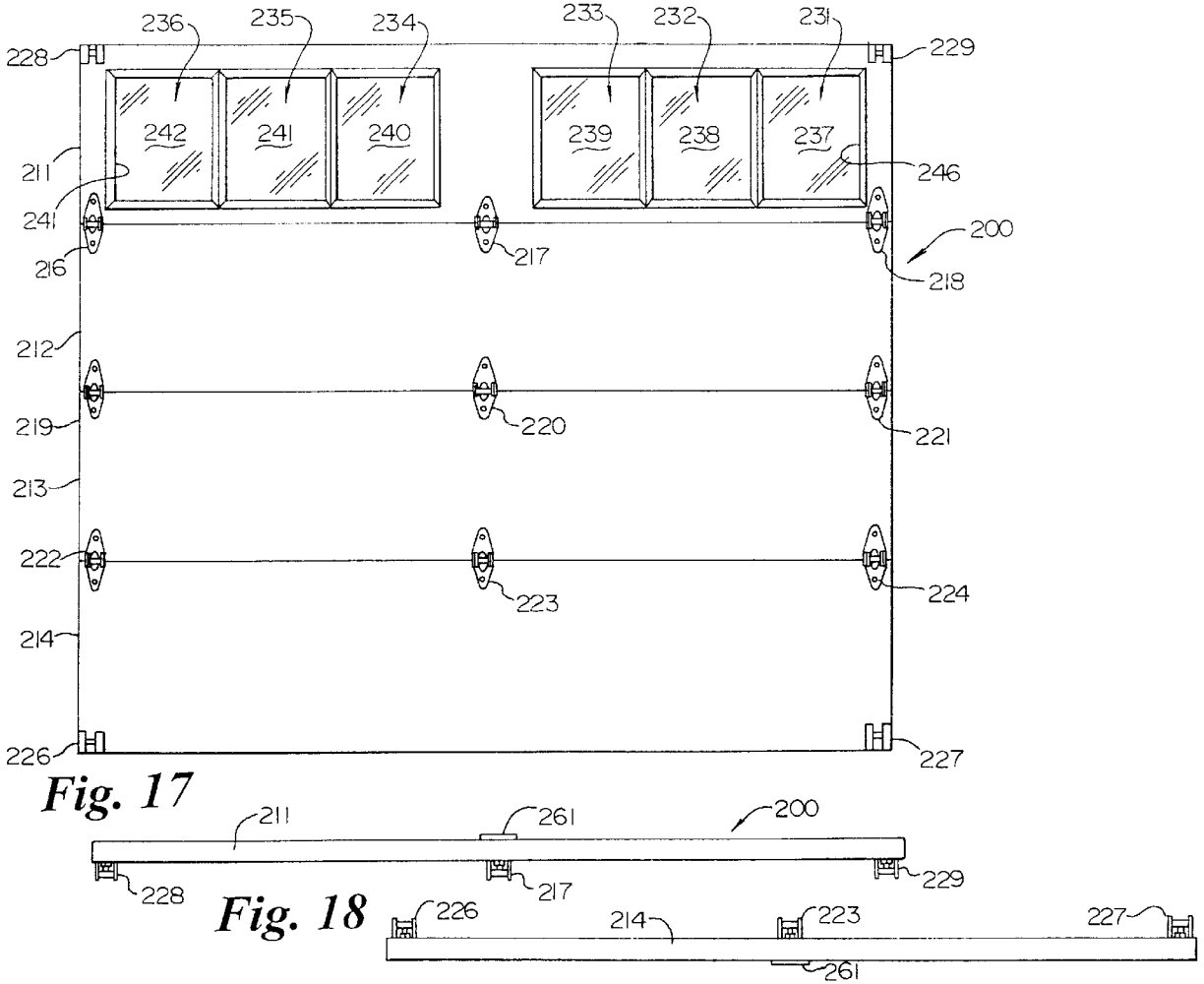
FIG. 16 is a rear elevation view of the door of FIG. 14.
FIG. 17 is a top plan view of the door of FIG. 14.
FIG. 18 is a bottom plan view of the door of FIG. 14.
Figure 20:
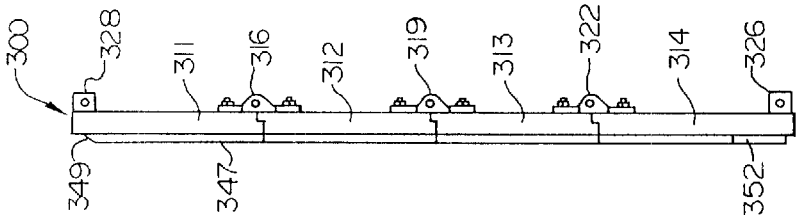
FIG. 20 is a side elevational view of the door of FIG. 19.

Top panel 211 has six identical windows 231, 232, 233, 234, 235 and 236 with transparent panes 237, 238, 239, 240, 241 and 242 surrounded with frames 244 and 245. As shown in FIG. 14, rectangular recessed sections 247, 248, 249, 250, 251 and 252 are located below windows 231, 232 and 233. Each section 247–252 has a generally rectangular shape and is surrounded with frame members 253. Rectangular recessed sections 254, 255, 256, 257, 258 and 259 are located below windows 234, 235 and 236. Each section 254–259 has a generally rectangular shape and is surrounded with frame members 260.

Figure 15:
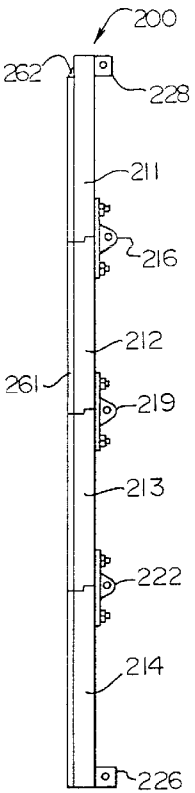
FIG. 15 is a side elevational view of the door of FIG. 14.

An upright center or post member 261 is located between frames 253 and 260 along the vertical middle of door 200. Member 261 has uniform width and extends from the bottom of the door to an upwardly tapered upper end 262. End 262 is located below the top edges of door 200 to allow door 200 to be located in surface engagement with the doorway header when door 200 is closed and permit door 200 to be opened. As seen in FIG. 15, center member 261 extends outwardly from the front of the door 200 providing door 200 with a two door facade. Center member 261 has a width of about six inches and a thickness of three quarters to one inch the width and thickness of center member 261 can vary to provide a sturdy center post appearance that has a two door facade.

Referring to FIGS. 19 to 23, there is shown a third modification of the single roll-up door or closure 300 having a three door facade for a doorway of a structure, such as a garage, shop, or building. Door 300 is movable from a generally vertical closed position to a horizontal open position to provide access to the structure. Door 300 is movable mounted with rollers on conventional side and overhead rails (not shown) for movement manually or with a powered opener between it's open and closed positions. Door 300 is a two-stall garage door for a garage doorway having a width to accommodate two motor vehicles, such as passenger cars, pick-up trucks and vans.

Door 300 has a plurality of elongated rectangular panels 311, 312, 313 and 314. Adjacent panels 311, 312 and 312, 313 and 313, 314 are pivotally connected with hinges 316, 317, 318 and 319, 320, 321 and 322, 323, 324 shown in FIG. 21, to permit articulated movement of the panels relative to each other as door 300 moves between it's open and closed positions and retain adjacent panels in side-by-side locations. Fasteners, each as bolts or screws (not shown) attach hinges 316 to 324 to the insides of panels 311 to 314. The inside of lower panel 314 has opposite lower corners supporting U-shaped brackets 326 and 327. The inside of upper or top panel 311 has opposite upper corners that support U-shaped brackets 328 and 329. Brackets 326 to 329 accommodate conventional axle and roller assemblies (not shown) which ride on side and overhead rails. Hinges 316, 318, 319, 321, 322, 324 have structures that accommodate the conventional axle and roller assemblies that ride on the side and overhead rails and position door 300 against the door frame when it is in the closed position.

Figure 19:
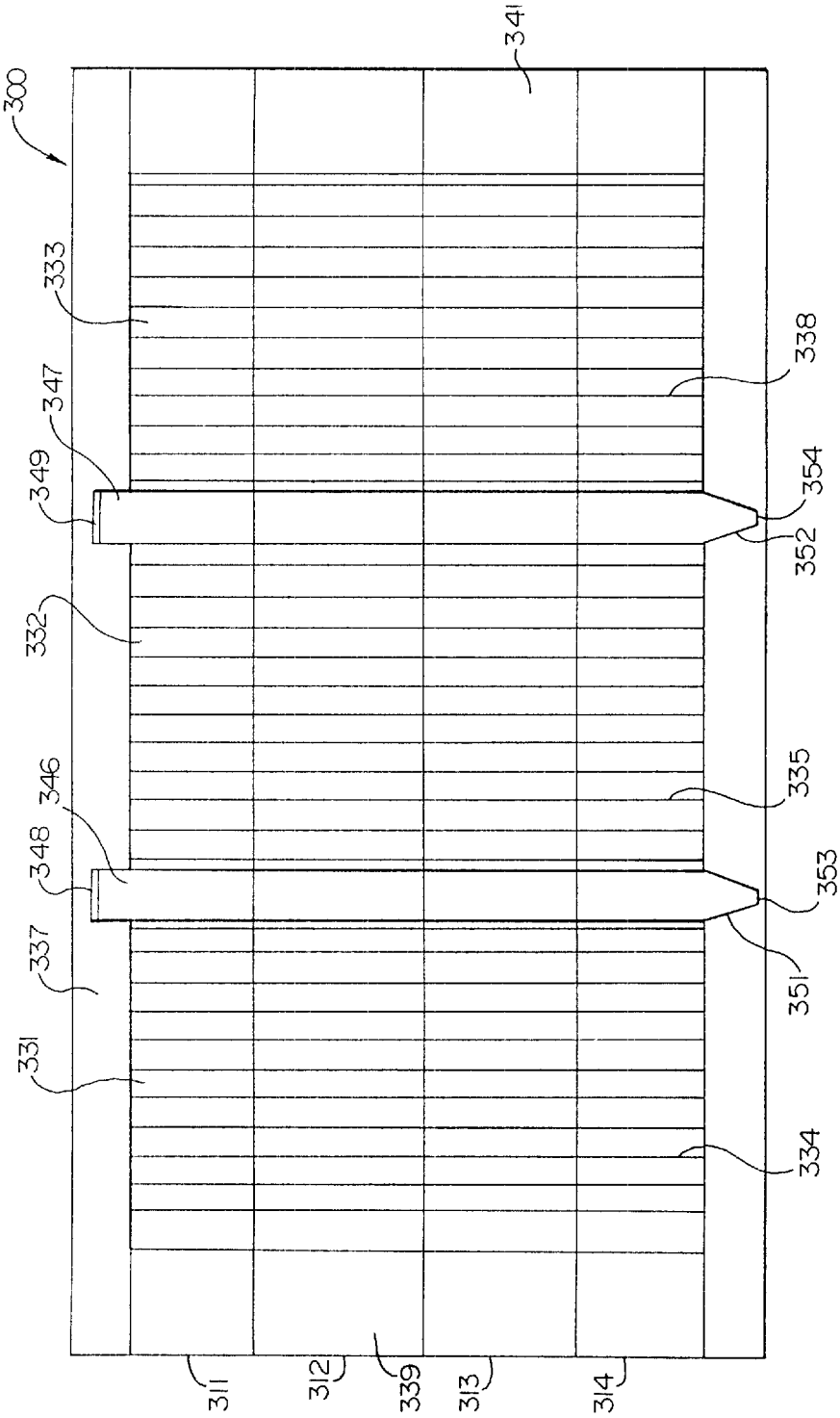
FIG. 19 is a front elevational view of a third modification of a single roll-up door with a three door facades of the invention.

As shown in FIG. 19, the front of door 300 has three shut members 331, 332 and 333 having vertical grooves 334, 335, and 336. The grooves are parallel V-grooves in the outside surface of the members. The grooves can have other shapes including but not limited to arcuate and square. Sheet members 331, 332 and 333 are plywood sheets with cedar facing. The sheets are horizontally cut to separate adjacent panels 331–314.

Figure 21:
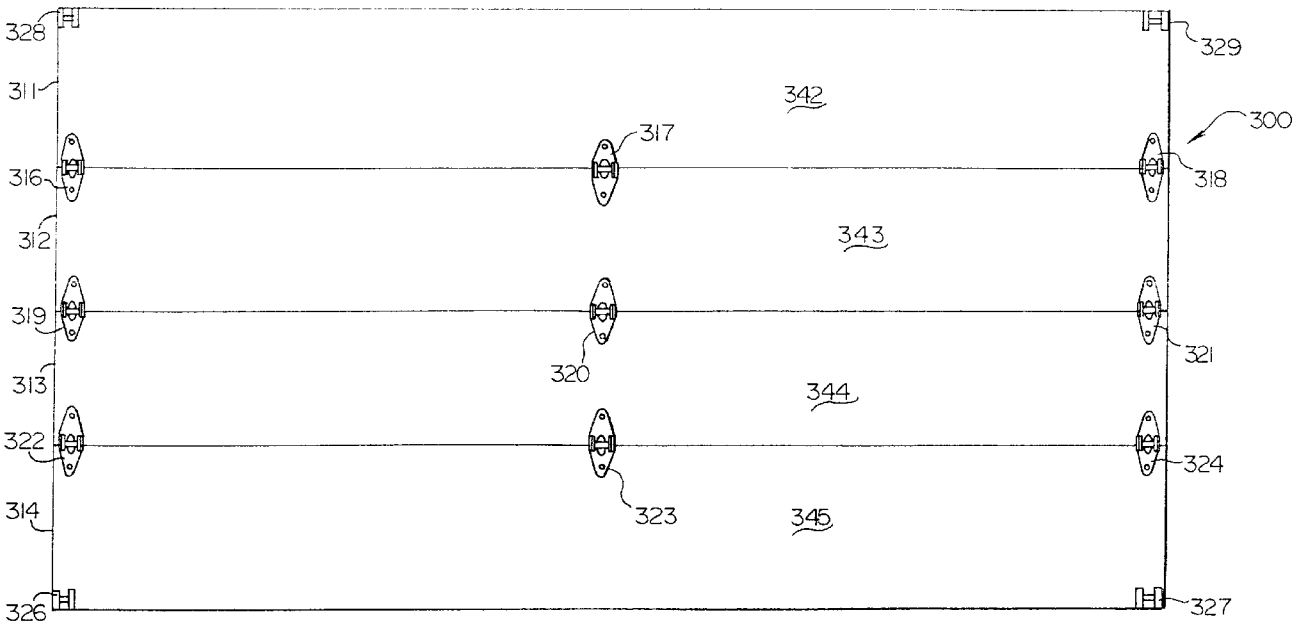
FIG. 21 is a rear elevational view of the door of FIG. 19.
Figure 22:
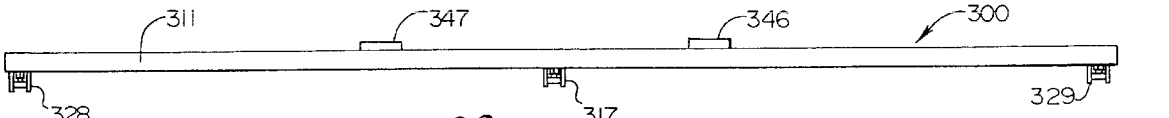
FIG. 22 is a top plan view of the door of FIG. 19.
Figure 23:
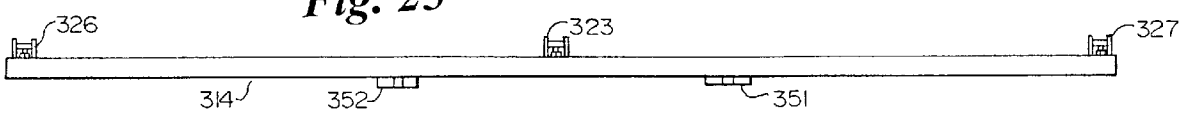
FIG. 23 is a bottom plan view of the door of FIG. 19.

A horizontal header 337 extends horizontally across the top of door 300 above sheet members 331, 332 and 333. A bottom member 338 extends horizontally across the bottom of door 300. Upright side members 339 and 341 on opposite ends of door 300 extend between members 337 and 338. Members 337, 338, 339 and 341 have outer surfaces located generally in the plane of the outer surface of sheet members 331, 332, and 333. Sheet members 331, 332, and 333 and members 337, 338, 339 and 341 are attached to internal framework (not shown) of door 300. As shown in FIG. 21, flat sheet members 342, 343, 344 and 345, as plywood sheets, attached to the framework cover the insides of panels 311–314.

Returning to FIGS. 19 and 20 a pair of upright post-like members 346 and 347 separate the front of door 300 into three visual sections emphasized by sheet members 331, 332 and 333. Member 346 has uniform width and extends from bottom member 338 to top member 339. Members 346 and 347 project outwardly from sheet members 331–333 and have a post like apparatus. The top end 348 of member 346 tapers upwardly and is located below the top edges of panel 311. The top edge 349 of member 347 also has a taper and is located below the top edge of panel 311 to allow door 300 to be located in surface engagement with the doorway header when the door is closed and permits door 300 to be moved upwardly to the open position. The bottom ends 351 and 352 of post-like members 346 and 347 taper inwardly and downwardly to enhance the drainage of water from members 346 and 347. The bottom portions 353 and 354 of members 346 and 347 are above the bottom edge of panel 314.

While there has been shown and described several embodiments of the door of the invention, it is understood that changes and modifications in structures and materials and door facades may be made by those skilled in the art without departing from the invention. The invention is defined in the following claims.

What is claimed is:

1. A roll-up door having a front facade having the appearance of two doors comprising: a plurality of horizontally extended panels, each panel including a front wall and opposite ends, pivot means connecting adjacent panels for horizontal pivoting movement of the panels relative to each other, a frame attached to the front walls of the panels, said frame having first upright side members adjacent opposite ends of the front wall attached to the front wall of each panel, and a second upright member attached to the front wall in the center of the front wall of each panel, and an upright center post member attached to the second upright member of the frame of each panel, said center post member having an upper end located below the top of the door and extended outwardly from the second upright member of the frame whereby said front walls of the panels, first and second upright members of the frame, and center post member of the panels have a front facade having the appearance of two doors.

2. The roll-up door of claim 1 wherein: the panels include a top panel, a bottom panel and at least one middle panel, said frame on the bottom panel has horizontal members attached to the front wall and extended between the upright side members.

3. The roll-up door of claim 1 wherein: the upright center of an uppermost one of the panels post member has a downwardly and outwardly beveled upper end located below the top of the door.

4. The roll-up door of claim 1 wherein: the second upright member is laterally spaced an equal distance from each first upright side member.

* * * * *